US010737518B2

(12) United States Patent
Takei et al.

(10) Patent No.: US 10,737,518 B2
(45) Date of Patent: Aug. 11, 2020

(54) RECORDING APPARATUS

(71) Applicant: SEIKO EPSON CORPORATION, Tokyo (JP)

(72) Inventors: Atsushi Takei, Nagano (JP); Yasuo Sunaga, Nagano (JP); Yasuaki Hirai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/163,719

(22) Filed: Oct. 18, 2018

(65) Prior Publication Data

US 2019/0118567 A1 Apr. 25, 2019

(30) Foreign Application Priority Data

Oct. 20, 2017 (JP) ..... 2017-203538

(51) Int. Cl.

| | |
|---|---|
| ***B41J 29/38*** | (2006.01) |
| ***B41J 11/42*** | (2006.01) |
| ***B41J 2/165*** | (2006.01) |
| ***B41J 13/00*** | (2006.01) |
| ***B41J 29/02*** | (2006.01) |
| ***B41J 29/13*** | (2006.01) |
| ***B41J 11/00*** | (2006.01) |

(52) U.S. Cl.

CPC ..... *B41J 29/38* (2013.01); *B41J 2/16508* (2013.01); *B41J 2/16523* (2013.01); *B41J 2/16526* (2013.01); *B41J 11/42* (2013.01); *B41J 13/0018* (2013.01); *B41J 29/02* (2013.01); *B41J 29/13* (2013.01); *B41J 11/005* (2013.01); *B41J 11/006* (2013.01); *B41J 2002/16573* (2013.01)

(58) Field of Classification Search

CPC .... B41J 29/38; B41J 2/16535; B41J 2/16505; B41J 2/16508; B41J 29/02; B41J 2/16523; B41J 2/16526; B41J 11/42; B41J 13/0009; B41J 13/0018; B41J 29/13; B41J 11/005; B41J 11/006; B41J 2002/16573; B41J 2/165; B41J 2/16511; B41J 2002/16514

See application file for complete search history.

(56) References Cited

U.S. PATENT DOCUMENTS

2017/0217188 A1* 8/2017 Mori ..... B41J 2/16508

FOREIGN PATENT DOCUMENTS

JP 2005-335929 A 12/2005

* cited by examiner

*Primary Examiner* — Jannelle M Lebron

(74) *Attorney, Agent, or Firm* — Global IP Counselors, LLP

(57) ABSTRACT

A recording apparatus includes a placement portion on which a medium is placed, a feeding portion that feeds the medium that is placed on the placement portion, a recording portion that has a liquid discharge portion that discharges liquid onto the medium that is fed by the feeding portion, a processing portion that executes pre-processing of the liquid discharge portion, and a control portion that performs control of the feeding portion and the processing portion or control of the feeding portion and the recording portion such that feeding of the medium and pre-processing are performed in parallel in a case where a recording start command is received in a state in which the processing portion faces the liquid discharge portion.

11 Claims, 6 Drawing Sheets

RECORDING APPARATUS

CROSS REFERENCES TO RELATED APPLICATIONS

The entire disclosure of Japanese Patent Application No. 2017-203538, filed Oct. 20, 2017 is expressly incorporated by reference herein.

BACKGROUND

1. Technical Field

The present disclosure relates to a recording apparatus.

2. Related Art

At present, various technologies are suggested to improve printing speed of a recording apparatus such as an ink jet printer or a laser printer. For example, in recent years, a technology is suggested that executes paper feeding in parallel with generation of image data in a case where a print job command is received (for example, refer to JP-A-2005-335929). When adopting such technology, it is possible to improve printing speed even in a recording apparatus with a long paper feeding path.

Note that, in an ink jet printer different from a laser printer that is described in JP-A-2005-335929, paper feeding is performed after executing pre-processing (for example, a process in which a cap member that covers a nozzle of a head for ink discharge is separated from the nozzle) after a print job command is received. Therefore, a comparatively long amount of time is necessary until printing of a first sheet is completed after the user instructs printing, and it is desired to further shorten the time that is necessary until printing is complete.

SUMMARY

An advantage of some aspects of the disclosure is to provide a recording apparatus that discharges and records liquid on a medium with the object of shortening the time until printing of a first sheet is complete after a user instructs printing.

According to an aspect of the disclosure, there is provided a recording apparatus including a placement portion on which a medium is placed, a feeding portion that feeds the medium that is placed on the placement portion, a recording portion that has a liquid discharge portion that discharges liquid onto the medium that is fed by the feeding portion, a processing portion that executes pre-processing of the liquid discharge portion, and a control portion that performs control of the feeding portion and the processing portion or control of the feeding portion and the recording portion such that feeding of the medium and pre-processing are performed in parallel in a case where the recording start command is received in a state in which the processing portion faces the liquid discharge portion.

When adopting this configuration, it is possible to perform feeding of the medium by the feeding portion and pre-processing using the recording portion and the processing portion in parallel in a case where the recording start command is issued in a state in which the processing portion faces the liquid discharge portion. That is, since it is possible to simultaneously execute feeding of the medium and pre-processing in a case where the recording start command is issued, it is possible to remarkably shorten the time that is necessary from when the recording start command is received until recording is started.

In the recording apparatus, it is possible to drive the feeding portion using a feeding motor and drive the processing portion using a processing motor. In such a case, it is possible to adopt a control portion that controls the feeding motor and the processing motor so as to perform feeding of the medium and pre-processing in parallel in a case where the recording start command is received in a state in which the processing portion faces the liquid discharge portion.

When adopting this configuration, it is possible to control the feeding motor and the processing motor so as to perform feeding of the medium by the feeding portion and pre-processing using the processing portion in parallel in a case where the recording start command is issued in a state in which the processing portion faces the liquid discharge portion.

In the recording apparatus, it is possible to further provide a transport portion that is disposed at a position downstream of the feeding portion and upstream of the liquid discharge portion on a transport path along which the medium is transported, and transports the medium that is fed by the feeding portion toward the liquid discharge portion. In such a case, it is possible to drive the transport portion and the processing portion using a common motor.

When adopting this configuration, since it is possible to drive the transport portion and the processing portion using a common motor, it is possible to reduce the number of motors used.

In the recording apparatus, it is possible to adopt the processing portion that has a cap that is able to cover the liquid discharge portion. In such a case, it is possible for the pre-processing to include a cleaning process for suctioning liquid from the liquid discharge portion by generating negative pressure in the cap in a state in which the liquid discharge portion is covered by the cap, and a cap opening process for separating the cap, which covers the liquid discharge portion, from the liquid discharge portion, and in this case, it is possible for the control portion to control the processing portion so as to perform the cleaning process and the cap opening process. It is possible for pre-processing to include a flushing process for discharging liquid from the liquid discharge portion in the cap in a state of being separated from the liquid discharge portion, and in this case, it is possible for the control portion to control the recording portion so as to perform the flushing process.

In the recording apparatus, it is possible for the control portion to determine whether or not a state of the recording apparatus is normal after the recording start command is received in the state in which the processing portion faces the liquid discharge portion, and to perform control of the feeding portion and the processing portion or control of the feeding portion and the recording portion so as to perform feeding of the medium and pre-processing in parallel in a case where the state of the recording apparatus is normal and perform feeding of the medium after the recording apparatus returns to the normal state and then pre-processing is complete in a case where the state of the recording apparatus is not normal.

When adopting this configuration, it is possible to perform control of the feeding portion and the processing portion or control of the feeding portion and the recording portion so as to perform feeding of the medium after pre-processing is complete in a case where the state of the recording apparatus is not normal (for example, in a case where medium jamming occurs on the transport path) even if the recording start command is issued. Accordingly, it is possible to temporarily postpone feeding of the medium until the state of the recording apparatus becomes normal (perform feeding of the medium until the state of the recording apparatus returns to normal).

In the recording apparatus, it is possible for the control portion to determine that the current state of the recording apparatus is normal in a case where recording of the previous time is normally completed by the recording apparatus. It is possible for the control portion to determine that the state of the recording apparatus is not normal in a case where medium jamming occurs on the transport path along which the medium is transported.

In the recording apparatus, it is possible to further provide an openable and closeable cover that covers the transport path. In such a case, it is possible for the control portion to perform control of the feeding portion and the processing portion or control of the feeding portion and the recording portion so as to perform feeding of the medium after pre-processing is complete in a case where the closure of the cover is detected after occurrence of medium jamming and opening of the cover is detected.

When adopting this configuration, it is possible to perform control of the feeding portion and the processing portion or control of the feeding portion and the recording portion so as to perform feeding of the medium after pre-processing is complete in a case where the closure of the cover is detected after occurrence of medium jamming and opening of the cover is detected. Accordingly, it is possible to temporarily postpone feeding of the medium until the medium jamming is eliminated (perform feeding of the medium after the medium jamming is eliminated).

BRIEF DESCRIPTION OF THE DRAWINGS

The disclosure will be described with reference to the accompanying drawings, wherein like numbers reference like elements.

DESCRIPTION OF EXEMPLARY EMBODIMENTS

An embodiment of a recording apparatus according to the disclosure will be described below with reference to the drawings. Note that, the disclosure is not restricted by the embodiment.

Summary of Printer

First, an outline of a recording apparatus according to an embodiment will be described mainly using FIGS. 1 to 3. The recording apparatus according to the embodiment is an ink jet printer 1 (hereinafter, simply referred to as "printer 1") that performs printing by discharging ink onto a medium such as recording paper.

Note that, in the X-Y-Z coordinate system that is indicated in each of the diagrams, an X direction is a scanning direction of a recording head 10 (FIG. 4), and is a width direction of a medium on which recording is performed. A Y direction is a device depth direction, and is a medium length direction. A Z direction is a direction of gravity, and is a device height direction. In addition, a +Y direction side is the apparatus front surface side, and a −Y direction side is the apparatus rear surface side. In addition, viewed from the apparatus front surface side, a left side is set as a +X direction and a right side is a −X direction. In addition, a +Z direction is an apparatus top (including an upper portion, an upper surface, and the like), and a −Z direction is an apparatus bottom (including a lower portion, a lower surface, and the like). In addition, hereinafter, a transport direction in which a paper sheet is transported in a printer 1 is referred to as "downstream", and a direction which is opposite thereto is referred to as "upstream".

Figure 1:
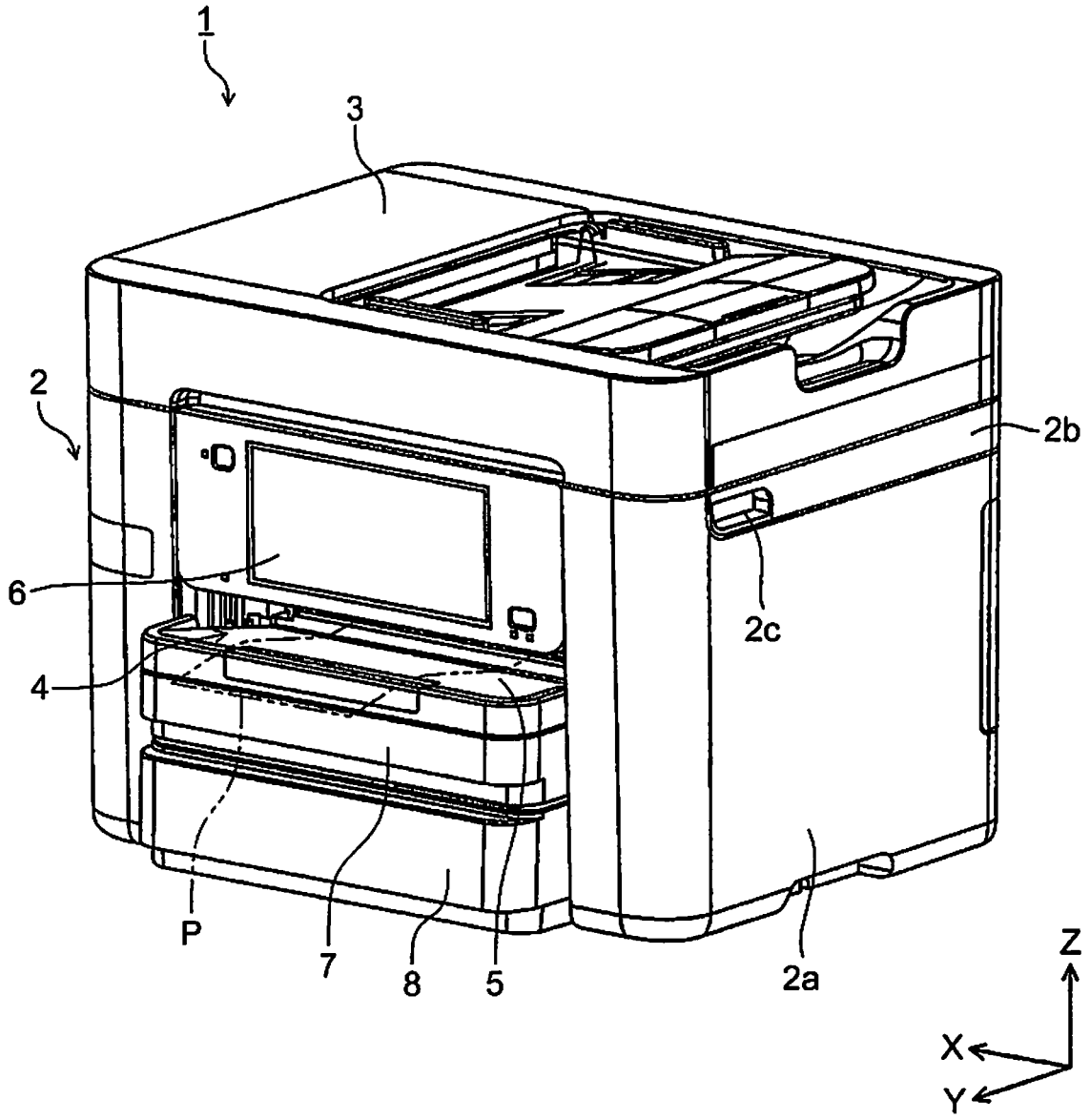
FIG. 1 is a perspective view representing an outer appearance of a printer according to an embodiment of the disclosure.
Figure 2:
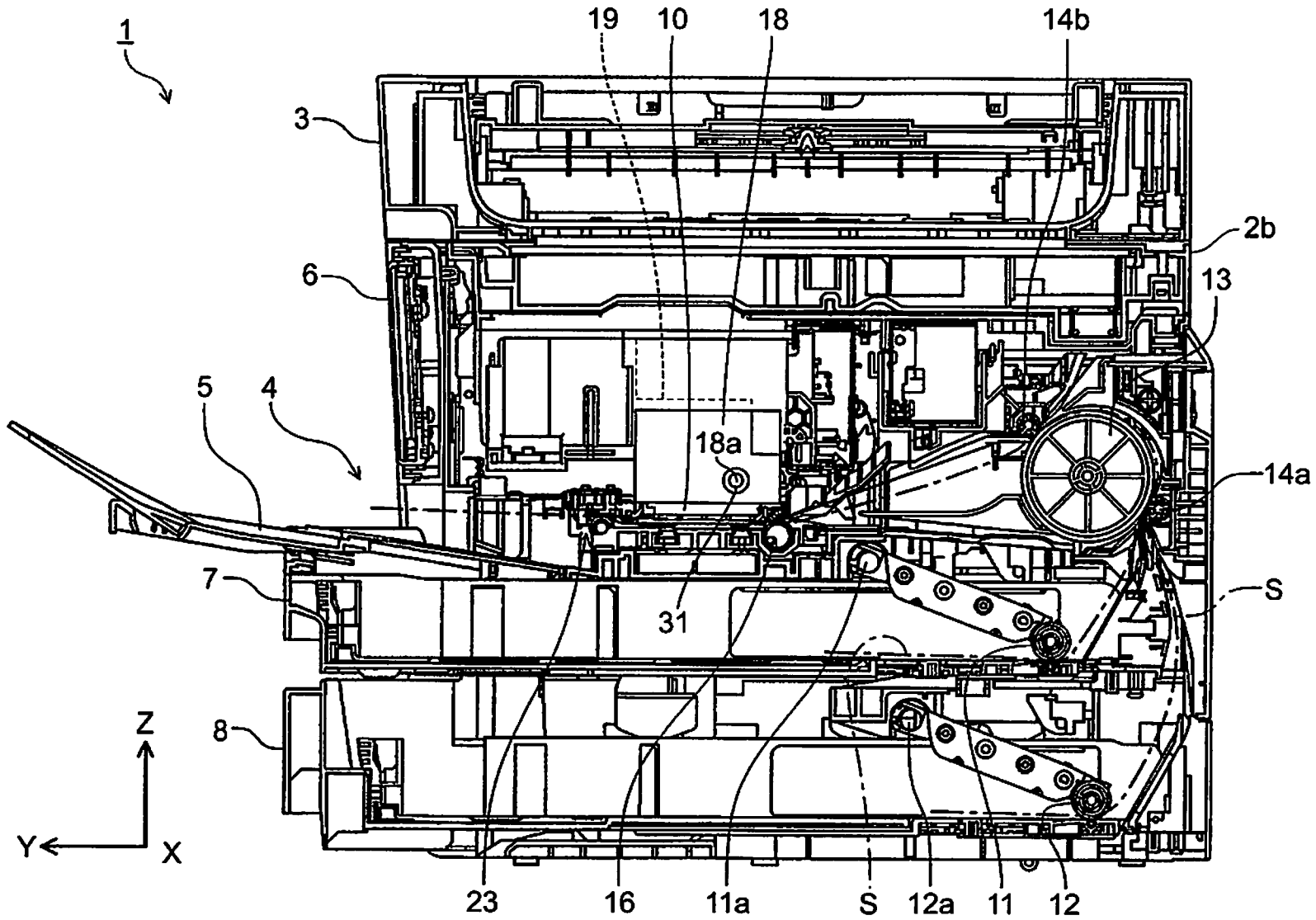
FIG. 2 is a side-sectional view of a printer according to an embodiment of the disclosure.

As shown in FIG. 1, the printer 1 is configured as a multifunction machine which is provided with a printer unit 2 that performs recording on a paper sheet P as the medium, and a scanner unit 3 that reads an image of a document. The scanner unit 3 is provided on an upper portion of the printer unit 2. Plain paper, thick paper, photo paper, and the like are exemplified as the paper sheet P on which recording is performed in the printer unit 2.

The paper sheet P after recording by the recording head 10 (FIG. 2) that is provided in the printer unit 2 issued from a discharge port 4 that is provided on the apparatus front surface in FIG. 1 and placed on a paper discharge tray 5. A reference numeral 6 on the apparatus front surface is an operation panel that is provided with a power button, an operation button for performing various print settings or recording execution, a display portion that performs preview display and the like for print setting contents and a print image, and the like.

The printer unit 2 has a rectangular cube shape main body portion 2*a* and a lid portion 2*b* that is disposed to be openable and closeable with respect to the upper surface opening, which is not illustrated in the drawings, of the main body portion 2*a*. A concave shape grasping portion 2*c* is provided on a side surface front side (+Y direction side) of the lid portion 2*b*. The user grasps the grasping portion 2*c* lifting upward, and the lid portion 2*b* is disposed at an open position, which is not illustrated in the drawings, in which the upper portion of the main body portion 2*a* is opened from the closed position that is indicated in FIG. 1 by rotating the lid portion 2*b* in the opening direction along with the scanner unit 3. In a state in which the lid portion 2*b* is at the open position, it is possible to expose the printing mechanism that is an inner portion of the main body portion 2*a*, and perform replacement work and elimination work of a paper jam for the ink cartridge 19 by the user. That is, the lid portion 2*b* is equivalent to the cover in the disclosure. In the embodiment, a sensor, which is not illustrated in the drawings, is provided that detects the open and closed states of the lid portion 2*b*. The detection result by the sensor is sent to a control portion 20 (FIG. 3) which will be described later, and is used for control of various motors and the like.

Paper Sheet Transport Path in Printer

Next, a transport path of the paper sheets P in the printer unit 2 will be described mainly with reference to FIG. 2 and FIG. 3. Note that, in FIG. 2 and FIG. 3, a dashed line S indicates the transport path of the paper sheets.

The printer unit 2 is provided on two levels with a paper sheet tray 7 and a paper sheet tray 8 that accommodate a plurality of paper sheets P on a bottom portion, and feeds the paper sheets one sheet at a time from one of the paper sheet tray 7 and the paper sheet tray 8. The paper sheet tray 7 and the paper sheet tray 8 are equivalent to the placement portion in the disclosure.

The paper sheets P are temporarily sent to the apparatus rear surface side (−Y direction) from the paper sheet tray 7 by a first feeding roller 11, and are bent by an intermediate roller 13 that is driven by a first driving source 15 (FIG. 3) and sent to the apparatus front surface side (+Y direction). In addition, in the same manner from the paper sheet tray 8, the paper sheets P are temporarily sent to the apparatus rear surface side by a second feeding roller 12, and are bent by the intermediate roller 13 and sent to the apparatus front surface side. Reference numerals 14*a*, 14*b* are driven rollers that are drivably rotated by the rotation of the intermediate roller 13. The transport path of the paper sheets P that are fed from the paper sheet tray 7 and the transport path of the paper sheets P that are fed from the paper sheet tray 8 merge at the front side (upstream side) at a nip point of the intermediate roller 13 and the driven roller 14*a*.

The first feeding roller 11 and the second feeding roller 12 are configured to be swingable with respective swing shafts 11*a*, 12*a* as axes, and are configured so as to contact the top paper sheet P out of a plurality of paper sheets P that are accommodated in the paper sheet tray 7 and the paper sheet tray 8.

The first feeding roller 11 is configured so as to be driven by the first driving source 15 (FIG. 3) commonly with the intermediate roller 13. The first driving source 15 is a motor that is able to rotate forward and rotate in reverse, for example, when the first driving source 15 drives to rotate forward, both the first feeding roller 11 and the intermediate roller 13 rotate in the transport direction, and when the first driving source 15 drives to rotate in reverse, only the intermediate roller 13 rotates in the transport direction. The second feeding roller 12 is driven by the first driving source 15 and a separate driving source (separate motor which is not illustrated in the drawings).

When feeding from the paper sheet tray 7, the first driving source 15 drives forward to rotate both the first feeding roller 11 and the intermediate roller 13 in the transport direction, and the driving source for the second feeding roller 12 stops. Meanwhile, when feeding from the paper sheet tray 8, the first driving source 15 drives in reverse to rotate only the intermediate roller 13 in the transport direction, and the driving source for the second feeding roller 12 drives.

Figure 3:
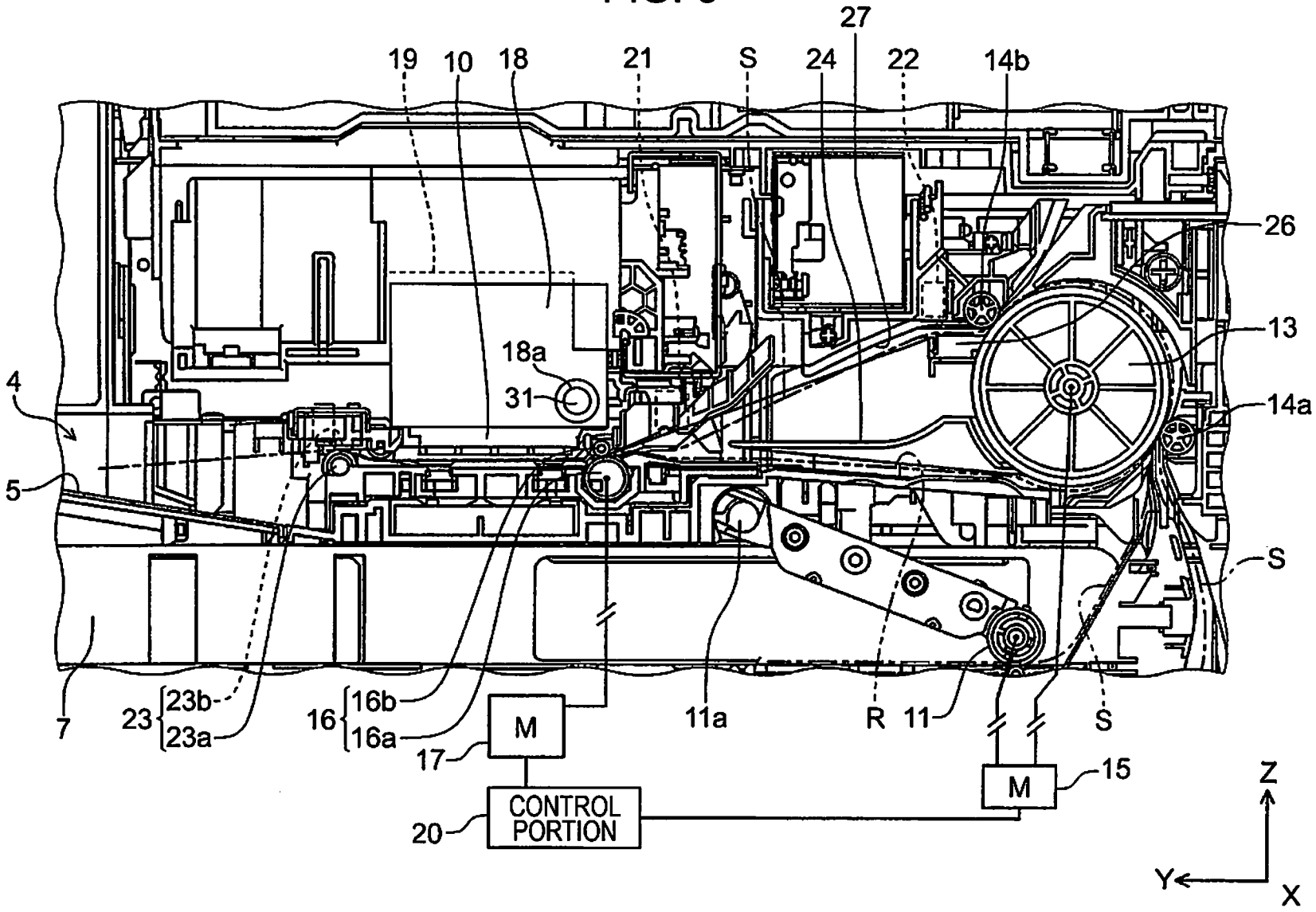
FIG. 3 is a diagram representing a paper transport path in the printer according to an embodiment of the disclosure.

The motors for the first driving source 15 and the second feeding roller 12 are equivalent to the feeding motor in the disclosure, and driving of these motors is controlled by the control portion 20 which will be described later (FIG. 3). In addition, the motors for the first feeding roller 11, the second feeding roller 12, the intermediate roller 13, the driven rollers 14*a*, 14*b*, the first driving source 15, and the second feeding roller 12 configure the feeding portion in the disclosure.

As shown in FIG. 3, a guiding member 26 that guides the paper sheets P that are fed out from a nip location of the intermediate roller 13 and the driven roller 14*b* and changes the feeding out direction to the target direction is disposed at a position immediately on the downstream side of the nip location. During feeding of the paper sheets P, the paper sheets P that are fed out from the nip location of the intermediate roller 13 and the driven roller 14*b* are transported so as to face obliquely down while maintaining the upper limit height along the oblique guide surface 27 (FIG. 3). In addition, a support member 24 is disposed below the guide surface 27 so as to support a hanging part when the fed paper sheets P are in a state of hanging down from the guiding member 26 and supports a rear end portion of the paper sheets P after falling down from the guiding member 26.

A pair of transport rollers 16 that transport the paper sheets P are provided on the downstream side of the intermediate roller 13. The pair of transport rollers 16 are provided with a transport driving roller 16*a* which is rotatably driven by the second driving source 17 (FIG. 3), and a transport driven roller 16*b* that is driven to rotate contacting the transport driving roller 16*a*. The second driving source 17 is a motor that is able to rotate forward and rotate in reverse, for example, when the second driving source 17 drives to rotate forward, the transport driving roller 16*a* rotates forward in the transport direction, and when the second driving source 17 drives to rotate in reverse, the transport driving roller 16*a* rotates in the opposite direction from the transport direction. Driving of the second driving source 17 (motor) is controlled by the control portion 20 which will be described later (FIG. 3). The pair of transport rollers 16 and the second driving source 17 configure the transport portion in the disclosure.

A first sensor 21 (FIG. 3) that detects an end portion position of the paper sheet P that is transported on the upstream side of the pair of transport rollers 16, and a second sensor 22 (FIG. 3) that detects the end portion position of the paper sheet P that are transported on the upstream side of the first sensor 21 are provided between the intermediate roller 13 and the pair of transport rollers 16 on the transport path for the paper sheets P. Note that, in the embodiment, the first sensor 21 and the second sensor 22 are lever-type sensors, but for example, it is also possible to use optical-type sensors.

The recording head 10 that performs recording on the paper sheet P is provided on the downstream side (apparatus front surface side, +Y axis direction) of the pair of transport rollers 16. The paper sheet P is sent below the recording head 10 by the pair of transport rollers 16.

The recording head 10 is held in a carriage 18 configured to be movable in a width direction (X axis direction) that intersects the paper transport direction (Y axis direction), and is configured so as to perform recording by discharging ink as "liquid" onto the paper sheet P from a nozzle 10*a* (FIG. 5) that is provided on the lower surface of the recording head 10. The nozzle 10*a* is equivalent to the liquid discharge portion in the disclosure. An ink cartridge 19 that supplies ink to the recording head 10 is installed in the carriage 18.

Figure 4:
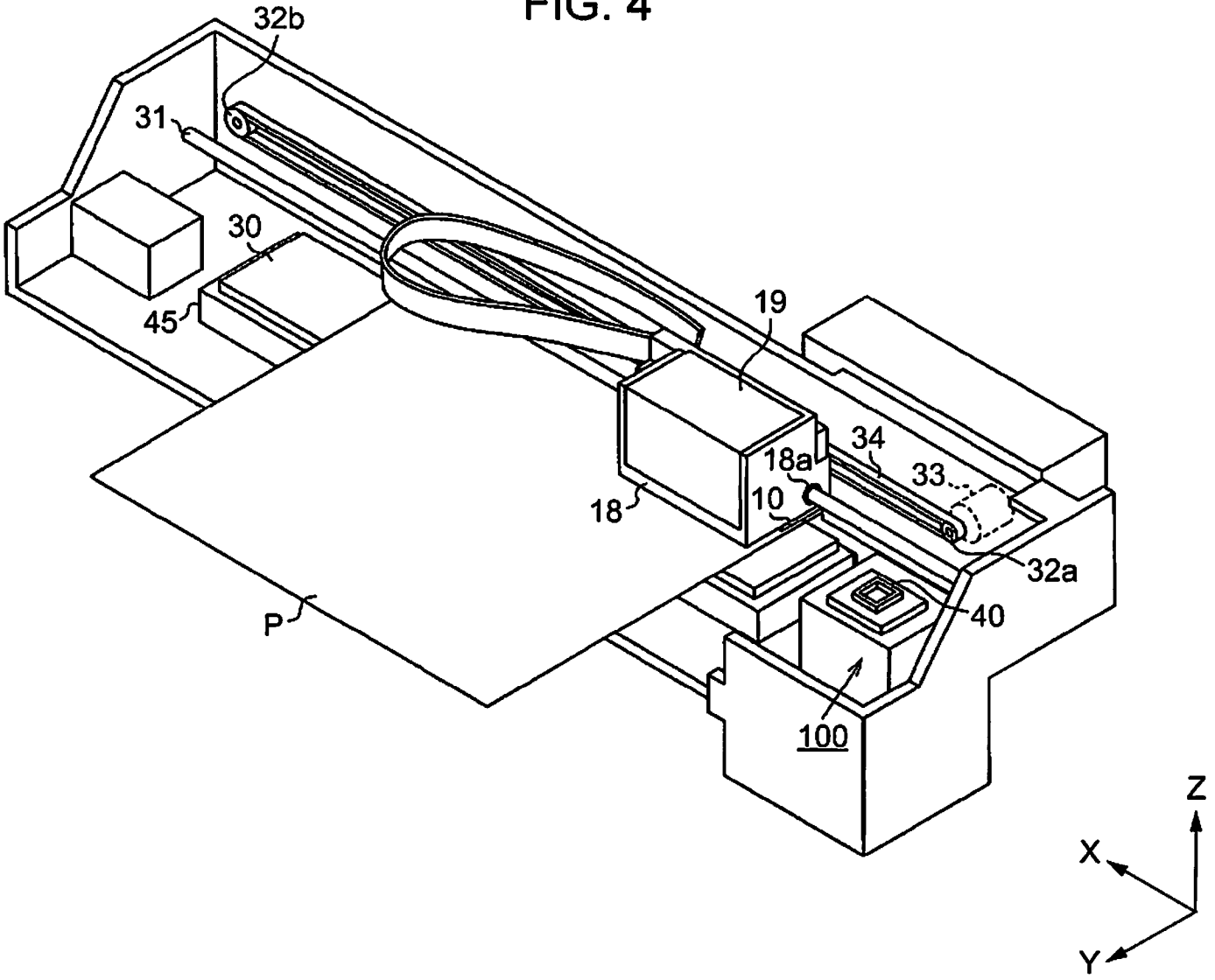
FIG. 4 is a perspective view representing an internal configuration of a printer according to an embodiment of the disclosure.

As shown in FIG. 4, a support base 30 extends along the transport direction (X axis direction) on the lower portion of the recording head 10, and the paper sheet P is fed from the rear side on the support base 30. A guide shaft 31 bridges along an extension direction (X axis direction) of the support base 30 above the support base 30. The carriage 18 is supported on the guide shaft 31 to be able to reciprocate in the axial direction. In detail, a support hole 18*a* that passes through the carriage 18 in a left and right direction is formed, and the guide shaft 31 is inserted into the support hole 18*a*. Note that, it is also possible to support the carriage 18 to be able to reciprocate at two locations by a pair of upper and lower guide rails in place of supporting the carriage 18 using the guide shaft 31.

As shown in FIG. 4, a driving pulley 32*a* and a driven pulley 32*b* are respectively disposed to freely rotate at a position in the vicinity of both ends of the guide shaft 31. The output shaft of the carriage motor 33 is connected to the driving pulley 32*a*, and an endless timing belt 34 that is connected to the carriage 18 is wound around a portion of the driving pulley 32*a* and the driven pulley 32*b*. The printer unit 2 is structured to be able to reciprocally move the carriage 18 in the left and right direction (X axis direction) while guiding the carriage 18 using the guide shaft 31 via the timing belt 34 by driving the carriage motor 33. Driving of the carriage motor 33 is controlled by the control portion 20 which will be described later (FIG. 3).

In addition, the recording head 10 is provided with a third sensor, which is not illustrated in the drawings, for detecting the end portion position in the paper sheet transport direction (Y axis direction) and the end portion position in the width direction (X axis direction) of the paper sheet P. The third sensor is an optical-type sensor that is provided with a light-emitting portion that radiates light toward the paper sheet P and a light-receiving portion that receives reflected light of light that is radiated from the light-emitting portion.

A pair of discharge rollers 23 are provided on the downstream side (apparatus front surface side, +Y axis direction) of the recording head 10. The pair of discharge rollers 23 are provided with a discharge driving roller 23*a* and a discharge driven roller 23*b* that is rotated to drive contacting the discharge driving roller 23*a*, and the paper sheet P after recording is nipped by the discharge driving roller 23*a* and the discharge driven roller 23*b*, and discharged to the paper discharge tray 5 that is provided on the apparatus front surface side. The discharge driving roller 23*a* drives and rotates by the second driving source 17 (FIG. 3) that is already described.

Note that, the printer 1 is configured to be able to print on both surfaces, and a switchback path R is provided that is indicated by a two-dot chain line in FIG. 3. The paper sheet P on which recording on the front surface is finished is configured to be fed in the −Y axis direction by reversely rotating the pair of transport rollers 16 or the pair of discharge rollers 23, passes through the switchback path R, is nipped again by the intermediate roller 13 and the driven roller 14*a*, is reversed, and enters the transport path S. The switchback path R is a path through which the lower part of the support member 24 (FIG. 3) passes.

In addition, the maintenance portion 100 is disposed on the lower part of the recording head 10 as a "processing portion" that is able to perform pre-processing of the nozzle 10*a*.

Maintenance Portion

In this arrangement, the configuration of the maintenance portion 100 will be described mainly with reference to FIG. 4 and FIG. 5.

As shown in FIG. 4, the maintenance portion 100 is disposed in a region further to the right side than the support base 30, that is, a region (home position region) that is not used during printing. In the printer unit 2, cleaning is regularly performed on the nozzle 10*a* of the recording head 10 by operating the maintenance portion 100 while moving the recording head 10 to the home position region. By such cleaning, for example, a stable ink meniscus MS (refer to FIG. 5) is formed in the nozzle 10*a* and the like, and an ejection characteristic of ink from the nozzle 10*a* is maintained.

Figure 5:
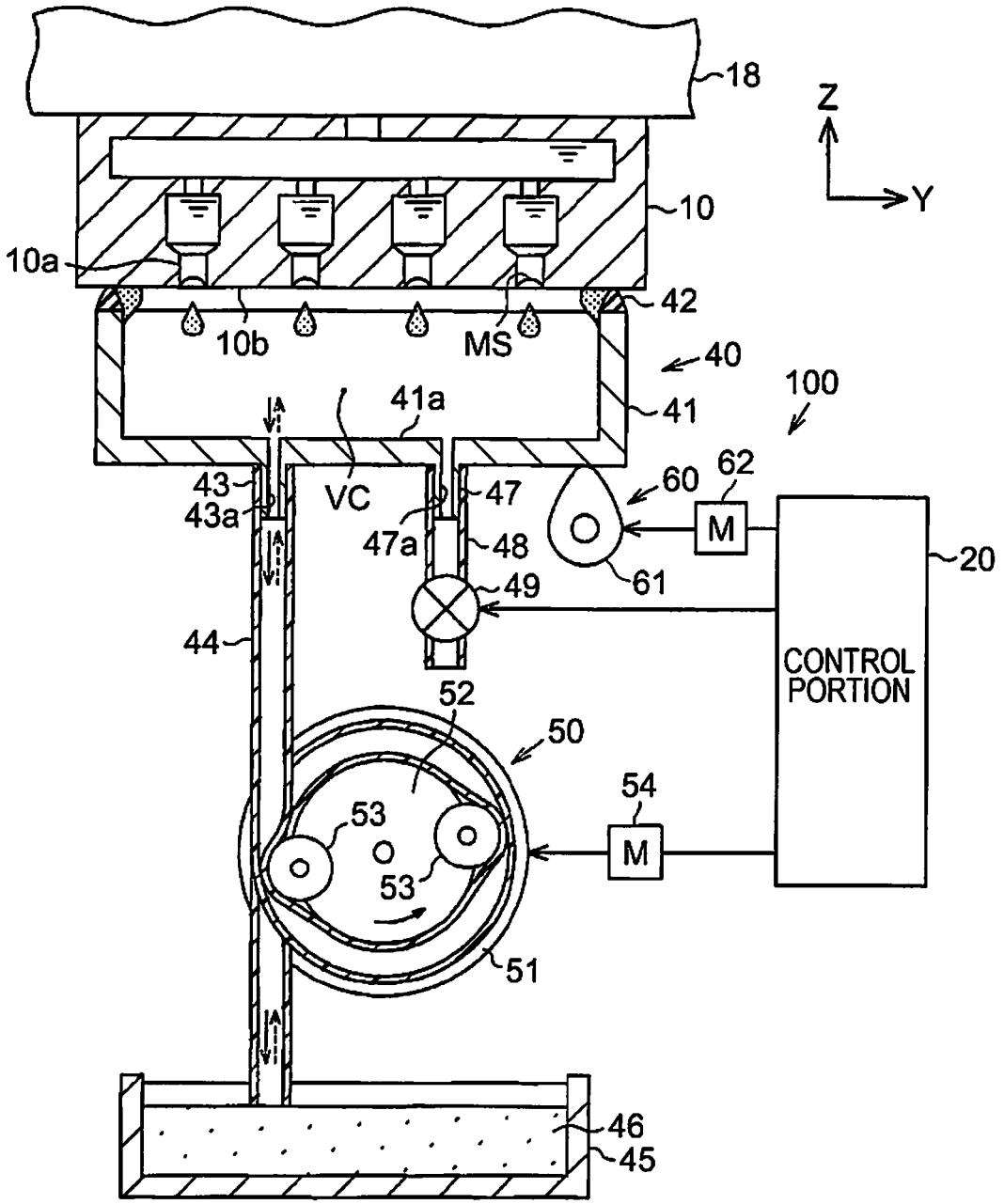
FIG. 5 is a functional configuration diagram of a maintenance portion of a printer according to an embodiment of the disclosure.

As shown in FIG. 5, the maintenance portion 100 is provided with a cap 40 that is able to cover the nozzle 10*a* of the recording head 10, a tube pump 50 for reducing pressure of the inner portion of the cap 40, and a lifting and lowering device 60 that lifts and lowers the cap 40. Note that, detailed description is omitted from the embodiment, but a wiper or the like, which is not illustrated in the drawings, is provided that wipes away unnecessary ink that is adhered to the nozzle formation surface 10*b* (FIG. 5) in the maintenance portion 100.

The cap 40 has a bottomed box shape cap main body 41, and a cap seal portion 42 that is formed in a square ring shape from a soft material (rubber material, elastomer, or the like) by the cap main body 41 on an opening portion on the upper side that is an abutting portion with the recording head 10 (nozzle formation surface 10*b*) in the cap main body 41. Note that, an ink absorption body, which is not illustrated in the drawings, that is formed from a porous material that absorbs ink according to need is inserted into the inner portion of the cap 40.

A protruding portion 43 protrudes downward from a position slightly rearward of a bottom wall 41*a* of the cap main body 41, and a discharge path 43*a* for discharging ink from within the cap 40 is formed so as to pass through the protruding portion 43 in the up and down direction. Then, a base end side (upstream side) of a flexible discharge tube 44 is connected to the protruding portion 43, and the other end side (downstream side) of the discharge tube 44 is inserted into a waste ink tank 45. Note that, a waste ink absorption member 46 that absorbs and holds ink that is discharged into the waste ink tank 45 is accommodated in the waste ink tank 45.

A tube pump 50 for suctioning within the cap 40 from the cap 40 side toward the waste ink tank 45 side is provided in a center portion of a discharge tube 44 between the cap 40 and the waste ink tank 45. The tube pump 50 has a pump case 51 that is substantially cylindrical, and the center portion of the discharge tube 44 in the length direction is accommodated in the pump case 51 so as to be along the inner peripheral wall of the pump case 51. In addition, a rotating body 52 that is able to rotate which is provided at the axial center of the pump case 51, and a pair of pressing rotating bodies 53 that are able to press the discharge tube 44 while moving along the inner peripheral surface of the pump case 51 while the rotating body 52 is rotated are accommodated within the pump case 51. The rotating body 52 is rotated and driven by a suction motor 54 that is a driving source. The suction motor 54 is equivalent to the processing motor in the disclosure.

In the tube pump 50, the pressing rotating body 53 rotates while sequentially crushing the intermediate portion of the discharge tube 44 from the cap 40 side (upstream side) to the waste ink tank 45 side (downstream side) in a case where the rotating body 52 is rotated in a counterclockwise direction as indicated by a solid line arrow in FIG. 5 based on rotational driving of the suction motor 54 in one direction (for example, forward direction). Then, air within the discharge tube 44 is expelled to the waste ink tank 45 side (downstream side) by the rotation of the pressing rotating body 53, and the inner portion of the discharge tube 44 on the cap 40 side (upstream side) and the inner portion of the cap 40 are further depressurized than the tube pump 50.

In addition, a protruding portion 47 protrudes downward from a position slightly forward of the bottom wall 41*a* of the cap main body 41, and an air release channel 47*a* for releasing air within the cap 40 is formed so as to pass through the protruding portion 47 in the up and down direction. Then, a base end side (upstream side) of a flexible air releasing tube 48 is connected to the protruding portion 47, and the other end side (downstream side) of the air releasing tube 48 is connected to an air release valve 49. In the embodiment, the air release valve 49 is an electromagnetic control valve, and the opening and closing of the valve is controlled by a predetermined electrical signal.

The lifting and lowering device 60 lifts and lowers the cap 40 by, for example, rotating an eccentric cam 61, which has on the outer periphery a cam surface that slides while contacting the lower surface of the cap 40, by a lifting and lowering motor 62 that is a driving source. That is, the cap 40 approaches the recording head 10 by the lifting movement and the cap seal portion 42 comes into contact with the nozzle formation surface 10*b*. By such abutment, a closed space VC is formed between the cap 40 and the nozzle formation surface 10*b*. In addition, the cap seal portion 42 of the cap 40 separates from the nozzle formation surface 10*b* by the lowering movement, and the closed space VC is configured so as to release air. The lifting and lowering motor 62 is equivalent to the processing motor in the disclosure.

Note that, in the embodiment, the carriage motor 33 (FIG. 4) that moves the carriage 18, and the lifting and lowering motor 62 (FIG. 5) that configures the lifting and lowering device 60 are common. When the carriage motor 33 is rotated forward, the cap 40 is lowered while the carriage 18 is made movable by releasing locking of the carriage 18. Meanwhile, when the carriage motor 33 is rotated in reverse, the cap 40 is lifted while the carriage 18 is locked and movement of the carriage 18 is blocked.

Control Portion

Next, the control portion 20 that controls various motors and the like will be described.

The control portion 20 is provided with a central processing unit (CPU) that executes various processes such as a printing process or a maintenance process, an electrically erasable programmable read-only memory (EEPROM) that is a type of non-volatile semiconductor memory that stores input printing data, a random access memory (RAM) that temporarily stores various data or temporarily develops an application program such as a printing process and the like, a PROM that is one type of non-volatile semiconductor memory that stores a control program or the like that controls each portion, and the like.

The control portion 20 determines whether or not the state of the printer 1 is normal after the recording start command is received in a state in which the cap 40 of the maintenance portion 100 faces the nozzle 10*a* of the recording head 10. Then, in a case where the state of the printer 1 is normal, the control portion 20 performs control of the first driving source 15 and the like (feeding motor) and the lifting and lowering motor 62 and the like (processing motor) or control of the first driving source 15 and the like (feeding motor) and the recording head 10 (recording portion) such that feeding of the paper sheet P and pre-processing are performed in parallel.

The "pre-processing" that is executed by the control portion 20 includes at least one of the three processes of a "cleaning process" in which ink (liquid) is suctioned from the nozzle 10*a* by negative pressure generated within the cap 40 in a state in which the nozzle 10*a* is covered by the cap 40 of the maintenance portion 100, a "cap opening process" in which the cap 40 that covers the nozzle 10*a* is separated from the nozzle 10*a*, and a "flushing process" in which ink (liquid) is discharged from the nozzle 10*a* onto the cap 40 in a state of being separated from the nozzle 10*a*. The control portion 20 controls the suction motor 54 and the lifting and lowering motor 62 (processing motors) of the maintenance portion 100 so as to perform the "cleaning process" and the "cap opening process". The control portion 20 controls the recording head 10 (recording portion) so as to perform the "flushing process".

Meanwhile, in a case where it is determined that the state of the printer 1 is not normal after the recording start command is received in a state in which the cap 40 of the maintenance portion 100 faces the nozzle 10*a* of the recording head 10, the control portion 20 performs control of the first driving source 15 and the like (feeding motor) and the lifting and lowering motor 62 and the like (processing motor) or control of the first driving source 15 and the like (feeding motor) and the recording head 10 (recording portion) such that feeding of the paper sheet P is performed after pre-processing is complete.

The control portion 20 in the embodiment determines that the state of the printer 1 is not normal in a case where a paper jam (jamming) occurs on the transport path S along which the paper sheet is transported. Then, in a case where closure of the lid portion 2*b* is detected after occurrence of a paper jam and opening of the lid portion 2*b* are detected, the control portion 20 performs control of the first driving source 15 and the like (feeding motor) and the lifting and lowering motor 62 and the like (processing motor) or control of the first driving source 15 and the like (feeding motor) and the recording head 10 (recording portion) such that feeding of the paper sheet P is performed after pre-processing is complete.

Parallel Control

Figure 6:
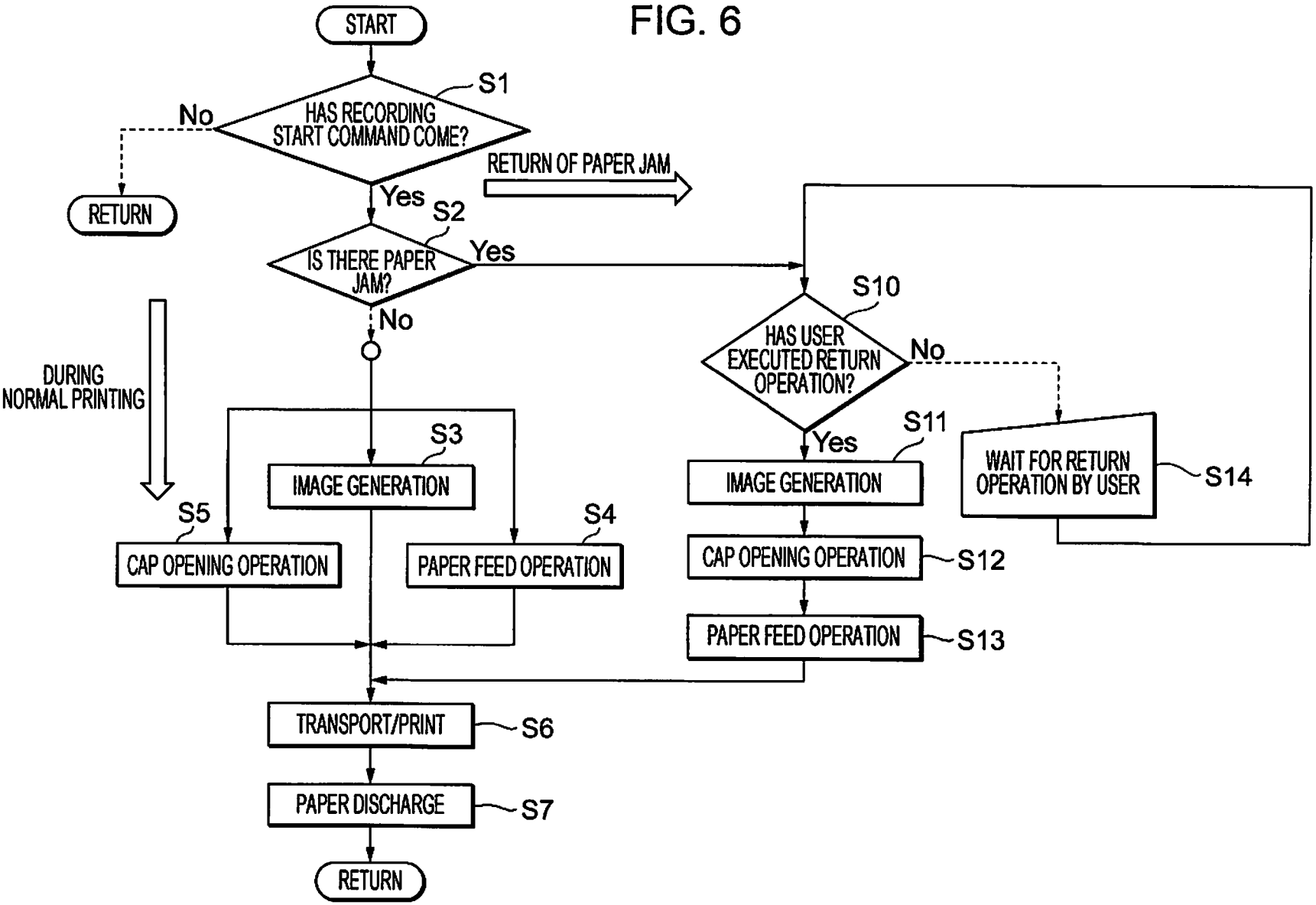
FIG. 6 is a flow chart for explaining parallel control by a control portion of a printer according to an embodiment of the disclosure.

Next, parallel control by the control portion 20 of the printer 1 according to the embodiment will be described in detail using the flow chart in FIG. 6.

First, the control portion 20 determines whether or not the recording start command is issued (start determination step: S1), and in a case where the recording start command is issued, it is determined whether or not something occurs on the transport path S (jam determination step: S2).

In the jam determination step S2, in a case where the control portion 20 determines that no paper jam occurs on the transport path S (that is, the state of the printer 1 is normal), the control portion 20 controls the first driving source 15 and the like and the lifting and lowering motor 62 so as to performs an image generation process (normal image generation step: S3), and perform feeding of the paper sheet P and the cap opening process in parallel (normal paper feed step: S4, normal pre-processing step: S5).

Meanwhile, in the jam determination step S2, in a case where the control portion 20 determines that a paper jam occurs on the transport path S (that is, the state of the printer 1 is not normal), the control portion 20 determines whether or not a return operation is performed by the user (return determination step: S10). In this arrangement, the "return operation" includes the recording start command being input by the operation of the operation panel 6 by the user in addition to closure by the user of the lid portion 2*b* that is opened to eliminate paper jams. Even in a case where the sensor that detects the opening and closing state of the lid portion 2*b* fails (or a case where no sensor is provided), the control portion 20 is able to determine whether or not the return operation is performed according to whether or not the recording start command is input.

In the return determination step S10, in a case where it is determined that the return operation is performed by the user, first, the control portion 20 controls the first driving source 15 and the like and the lifting and lowering motor 62 so as to perform the image generation process (abnormal image generation step: S11), and after that, perform in the stated order the cap opening process (abnormal pre-processing step: S12) and feeding of the paper sheet P (abnormal paper feed step: S13). Meanwhile, in the return determination step S10, the control portion 20 waits until the return operation is executed in a case where it is determined that there is no return operation by the user (wait step: S14).

Note that, as shown in FIG. 4, in a case where it is determined that there is a return operation by the user, the control portion 20 controls the carriage motor 33 so as to move the carriage 18 and the recording head 10 to the home position region (region on the right side viewed from the apparatus front surface side) in which the maintenance portion 100 is disposed. Note that, it is also possible to dispose the maintenance portion 100 and the home position region on the left side viewed from the apparatus front surface side. In this case, the control portion 20 controls the carriage motor 33 so as to move the carriage 18 and the recording head 10 to the home position region disposed on the left side viewed from the apparatus front surface side.

After passing through the normal paper feed step S4 and the normal pre-processing step S5, or the abnormal paper feed step S13, the control portion 20 controls the pair of transport rollers 16 and the recording head 10 so as to control transport and printing of the paper sheet P (transport printing step: S6). After that, the control portion 20 discharges the paper sheet P on which printing has been performed by controlling the pair of discharge rollers 23 (paper discharge step: S7), and the series of control ends.

In the printer 1 according to the embodiment that is described above, in a case where the recording start command is issued in a state in which the cap 40 faces the nozzle 10*a* of the recording head 10, it is possible to perform in parallel feeding of the paper sheet P by the feeding portion (first feeding roller 11, first driving source 15, or the like) and pre-processing by the recording head 10 or the maintenance portion 100. That is, since it is possible to simultaneously execute feeding of the paper sheet P and pre-processing in a case where the recording start command is issued, it is possible to remarkably shorten the time that is necessary after the recording start command is received until recording is started.

In addition, in the printer 1 according to the embodiment that is described above, in a case where the state of the printer 1 is not normal even when the recording start command is issued (a case where a paper jam occurs on the transport path S) and in a case where closure of the lid portion 2*b* is detected after occurrence of a paper jam and opening of the lid portion 2*b* are detected, it is possible to perform control of the first driving source 15 and the like (feeding motor) and the lifting and lowering motor 62 and the like (processing motor) or control of the first driving source 15 and the like (feeding motor) and the recording head 10 (recording portion) such that feeding of the paper sheet P is performed after pre-processing is complete. Accordingly, it is possible to temporarily postpone feeding of the paper sheet P until the paper jam is eliminated (perform feeding of the paper sheet P after the paper jam is eliminated).

Note that, in the embodiment, an example is indicated in which the motor for the "transport portion" and the motor for the "processing portion" are different, but it is also possible motor for the "transport portion" and the motor for the "processing portion" to be common. When setting in such a manner, it is possible to reduce the number of motors used. For example, it is possible to use the second driving source 17 that is the motor for the "transport portion" also as the lifting and lowering motor for the "processing portion". In such a case, it is possible to lower the cap 40 while being able to move the carriage 18 by releasing locking of the carriage 18 while rotating the transport driving roller 16*a* in the transport direction by driving the second driving source 17 forward. Meanwhile, it is possible to raise the cap 40 while blocking movement of the carriage 18 by locking the carriage 18 while rotating the transport driving roller 16*a* in the opposite direction from the transport direction by driving the second driving source 17 in reverse. In such a modification example, the second driving source 17 that is a common motor is equivalent to the processing motor in the disclosure.

In addition, in the embodiment, an example is indicated in which it is determined that the state of the printer 1 is normal in a case where a paper jam (jamming) does not occur on the transport path S along which the paper sheet is transported, but normal determination of the printer 1 is not limited thereto. For example, it is also possible to determine that the current state of the printer 1 is normal in a case where recording of the previous time (immediately before) is normally completed by the printer 1.

The disclosure is not limited to the embodiments described above, and a person skilled in the art of the embodiment is able to modify the design, as appropriate, within the range of the disclosure as long as the characteristics of the disclosure are provided. That is, it is possible to modify, as appropriate, without limiting each of the elements that the embodiment is provided with or the arrangement, materials, conditions, shape, size, and the like for each of the elements to those exemplified. In addition, it is possible to combine each of the elements that the embodiment is provided with as long as technically feasible, and the combinations thereof are also included in the range of the disclosure as long as the characteristics of the disclosure are included.

What is claimed is:

1. A recording apparatus comprising:

a placement portion on which a medium is placed;

a feeding portion that feeds the medium that is placed on the placement portion;

a recording portion that has a liquid discharge portion that discharges liquid onto the medium that is fed by the feeding portion;

a processing portion that executes pre-processing of the liquid discharge portion; and a control portion that performs control of the feeding portion and the processing portion or control of the feeding portion and the recording portion such that feeding of the medium and the pre-processing are performed in parallel in a case where a recording start command is received in a state in which the processing portion faces the liquid discharge portion, wherein the processing portion has a cap to cover the liquid discharge portion, the pre-processing includes a cap opening process for separating the cap, which covers the liquid discharge portion, from the liquid discharge portion, and the control portion performs the control of the feeding portion and the processing portion such that the feeding of the medium and the cap opening process are performed in parallel in a case where the recording start command is received in a state in which the processing portion faces the liquid discharge portion.

2. The recording apparatus according to claim 1, wherein the feeding portion is driven by a feeding motor, the processing portion is driven by a processing motor, and the control portion controls the feeding motor and the processing motor such that feeding of the medium and the pre-processing are performed in parallel in a case where the recording start command is received in a state in which the processing portion faces the liquid discharge portion.

3. The recording apparatus according to claim 2, further comprising:

a transport portion that is disposed at a position downstream of the feeding portion and upstream of the liquid discharge portion on a transport path along which the medium is transported, and transports the medium that is fed by the feeding portion toward the liquid discharge portion, wherein the transport portion and the processing portion are driven by a common motor.

4. The recording apparatus according to claim 1, the pre-processing includes a cleaning process for suctioning liquid from the liquid discharge portion by the generation of negative pressure in the cap in a state in which the liquid discharge portion is covered by the cap, and the control portion controls the processing portion so as to perform the cleaning process.

5. The recording apparatus according to claim 1, the pre-processing includes a flushing process for discharging liquid from the liquid discharge portion on the cap in a state of being separated from the liquid discharge portion, and the control portion controls the recording portion so as to perform the flushing process.

6. The recording apparatus according to claim 1, wherein the control portion determines whether or not a state of the recording apparatus is normal after the recording start command is received in the state in which the processing portion faces the liquid discharge portion, and performs control of the feeding portion and the processing portion or control of the feeding portion and the recording portion so as to perform feeding of the medium and pre-processing in parallel in a case where the state of the recording apparatus is normal and perform feeding of the medium after the recording apparatus returns to the normal state and then pre-processing is complete in a case where the state of the recording apparatus is not normal.

7. The recording apparatus according to claim 6, wherein the control portion determines that the current state of the recording apparatus is normal in a case where recording of the previous time is normally completed by the recording apparatus.

8. The recording apparatus according to claim 7, wherein the control portion determines that the state of the recording apparatus is not normal in a case where medium jamming occurs on the transport path along which the medium is transported.

9. The recording apparatus according to claim 8, further comprising:

an openable and closeable cover that covers the transport path, wherein the control portion performs control of the feeding portion and the processing portion or control of the feeding portion and the recording portion so as to perform feeding of the medium after pre-processing is complete in a case where the closure of the cover is detected after occurrence of medium jamming and opening of the cover is detected.

10. The recording apparatus according to claim 1, wherein the placement portion includes a paper sheet tray to accommodate a plurality of the medium.

11. The recording apparatus according to claim 10, wherein the feeding portion is configured to feed the medium located at a top of the plurality of the medium on the paper sheet tray.

* * * * *